US007938634B2

(12) United States Patent
Sun

(10) Patent No.: US 7,938,634 B2
(45) Date of Patent: May 10, 2011

(54) SELF-MODULATED SCROLL COMPRESSOR WITH OPTIMIZED BUILT-IN VOLUME RATIO

(75) Inventor: Zili Sun, Arkadelphia, AR (US)

(73) Assignee: Scroll Technologies, Arkadelphia, AR (US)

( * ) Notice: Subject to any disclaimer, the term of this patent is extended or adjusted under 35 U.S.C. 154(b) by 692 days.

(21) Appl. No.: 11/829,140

(22) Filed: Jul. 27, 2007

(65) Prior Publication Data

US 2009/0028724 A1 Jan. 29, 2009

(51) Int. Cl.
*F03C 2/00* (2006.01)
*F03C 4/00* (2006.01)
*F04C 2/00* (2006.01)

(52) U.S. Cl. ..... 418/55.2; 418/55.1; 418/55.5; 418/57; 418/150

(58) Field of Classification Search ..... 418/55.1–55.5, 418/57, 150; 417/440, 213, 283
See application file for complete search history.

(56) References Cited

U.S. PATENT DOCUMENTS 801,182 A * 10/1905 Creux ..... 418/55.2
4,650,405 A * 3/1987 Iwanami et al. ..... 418/55.1
5,103,652 A * 4/1992 Mizuno et al. ..... 418/55.6
5,458,471 A * 10/1995 Ni ..... 418/55.2

* cited by examiner

*Primary Examiner* — Theresa Trieu
(74) *Attorney, Agent, or Firm* — Carlson, Gaskey & Olds

(57) ABSTRACT

A self-modulating scroll compressor includes a built-in volume ratio that is defined as the ratio of a volume of a compression pocket just after completion of suction, i.e. at a beginning of a compression cycle, to the volume of the compression pocket just prior to discharge, i.e. at the end of the compression cycle. The built-in volume ratio can be controlled by the geometry of the scrolls and can be modified by, for example, extending the wrap or adding more turns to the wrap. Because the built-in volume ratio decreases to an effective volume ratio at lower capacity operation, the built-in volume ratio is at least 2.4 in order to optimize overall compressor efficiency.

4 Claims, 3 Drawing Sheets

SELF-MODULATED SCROLL COMPRESSOR WITH OPTIMIZED BUILT-IN VOLUME RATIO

BACKGROUND OF THE INVENTION

This invention relates to a self-modulating scroll compressor that includes a built-in volume ratio that optimizes overall compressor performance.

Scroll compressors are becoming widely utilized in refrigerant compression applications. In a scroll compressor, a first scroll member has a base and a generally spiral wrap extending from the base. A second scroll member is held in a non-orbiting fashion relative to the first scroll member and has a wrap that interfits with a wrap from the first scroll member. The first scroll member is driven to orbit relative to the second, and the interfitting wraps define compression chambers for compressing an entrapped refrigerant.

It is a goal in modern compressor design to be able to provide at least two capacity levels. In some instances, such as when the cooling load on a refrigerant cycle is not particularly high, a lower capacity may be desirable. Less energy is used to compress a lesser amount of refrigerant in low capacity operations. Thus, various modulation schemes have been developed in the prior art.

In one modulation scheme, the compressor moves to low capacity operation when the pressure differential is low. The pressure differential is the delta (difference) of the discharge pressure to the suction pressure. When this quantity is low, there is some indication that lower capacity operation may be in order.

This prior art compressor performs adequately to provide low capacity operation when the compressor is utilized in an air conditioning cycle. However, it is also desirable to use such compressors as part of a heat pump system. In a compressor that is utilized for both air conditioning and heat pump operation, there are times when a relatively low pressure differential is not indicative of a need for low capacity. In particular, if the suction pressure is also low, the compressor may be operating in heat pump mode, and high capacity operation would still be desirable. As such, the prior art also provides for self-modulation between low capacity operation and high capacity operation to accommodate for those circumstances.

However, because the prior art scroll compressors are compression machines with a fixed volume ratio, the design of the compressor is only optimized for a single operating condition with a certain pressure ratio. For example, a typical scroll compressor for an air conditioning application has a built-in volume ratio of 1.9-2.6. The built-in volume ratio is defined as the ratio of a pockets' volume just after completion of suction, i.e. at the beginning of a compression cycle, to the pockets' volume just prior to discharge, i.e. at the end of the compression cycle.

Prior art self-modulating scroll compressors are typically capable of adjusting compressor capacity in two steps to achieve higher overall system efficiency. The prior art self-modulating scroll compressors reduce capacity by utilizing valves to bleed vapor from the pockets back to suction, which delays the completion of suction and significantly reduces the built-in volume ratio to an effective volume ratio. If, however, the effective volume ratio is too low at the lower capacity stage, the compressor efficiency will be reduced. As such, in order to have an optimized volume ratio at the lower capacity stage, the scroll built-in volume ratio at full capacity should be higher than that of the prior art single stage scrolls. Therefore, it is desirable to provide a self-modulated scroll compressor with a built-in volume ratio that is greater than found in the prior art.

SUMMARY OF THE INVENTION

In a self-modulating scroll compressor, the built-in volume ratio decreases to an effective volume ratio when the self-modulating scroll compressor is operating under lower capacity conditions. The built-in volume ratio can be controlled by the geometry of the scrolls and can be modified by, for example, extending the wrap or adding more turns to the wrap. The volume ratio directly correlates to the overall efficiency of the scroll compressor. As such, in one example embodiment of the present invention, to optimize the overall system efficiency of the scroll compressor, the built-in volume ratio is at least 2.4. In another example embodiment of the present invention, the built-in volume ratio is at least 2.4 but less than 3.5.

These and other features of the present invention can be best understood from the following specification and drawings, the following of which is a brief description.

DETAILED DESCRIPTION OF THE PREFERRED EMBODIMENT

Figure 1:
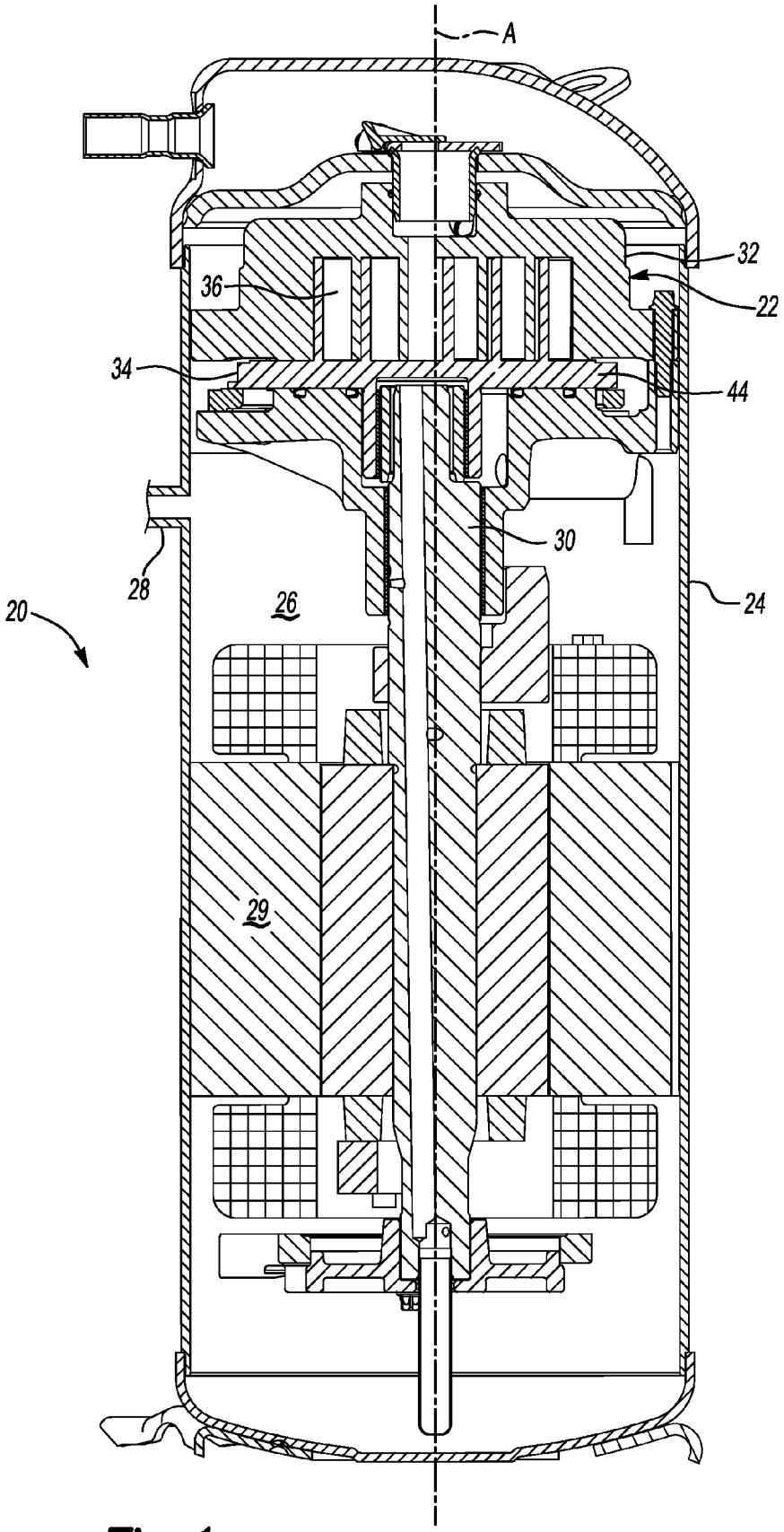
FIG. 1 is a cross-sectional view of an example scroll compressor.

FIG. 1 shows a scroll compressor 20 including a compressor pump set 22 mounted within a sealed shell 24. A suction chamber 26 receives a suction refrigerant from a tube 28. This refrigerant can circulate within the suction chamber 26 and flow over an electric motor 29. The electric motor 29 drives a shaft 30 that defines an operative axis A of the scroll compressor 20. The compressor pump set 22 includes a non-orbiting scroll 32 and an orbiting scroll 34. As is known, shaft 30 drives the orbiting scroll 34 through a non-rotational coupling to orbit relative to the non-orbiting scroll 32. A port including a by-pass valve opened to allow the capacity of the compressor 20 to be reduced, as is known.

Figure 2:
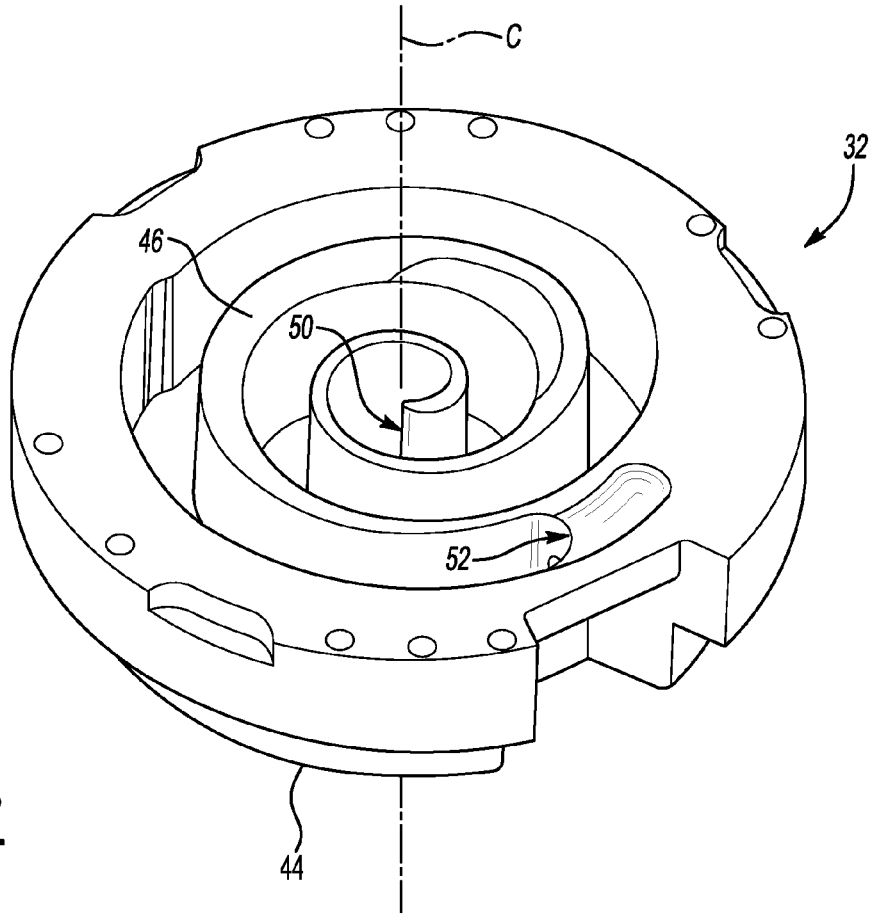
FIG. 2 is a perspective view of a non-orbiting scroll member for use in the scroll compressor of FIG. 1.
Figure 3:
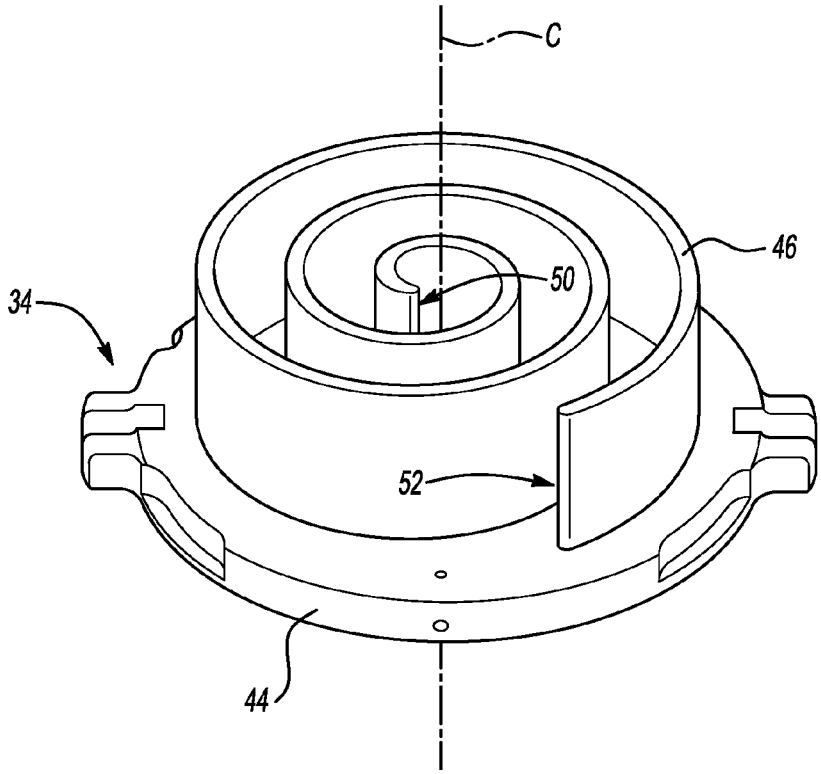
FIG. 3 is a perspective view of an orbiting scroll member for use in the scroll compressor of FIG. 1.

FIGS. 2 and 3 show perspective views of the non-orbiting scroll 32 and the orbiting scroll 34 respectively. Each of the non-orbiting scroll 32 and the orbiting scroll 34 include a base portion 44 and a generally spiral wrap 46 that extends from the base portion. When assembled, the spiral wraps 46 interfit to define the compression pocket 36 (FIG. 1) between the non-orbiting scroll 32 and the orbiting scroll 34. In addition, each of the generally spiral wraps 46 include a first end 50 and a second end 52 that define a wrap length L, which "wraps" around an axis C. Each time that each generally spiral wrap 46 "wraps" around the axis C constitutes a single turn.

Figure 4:
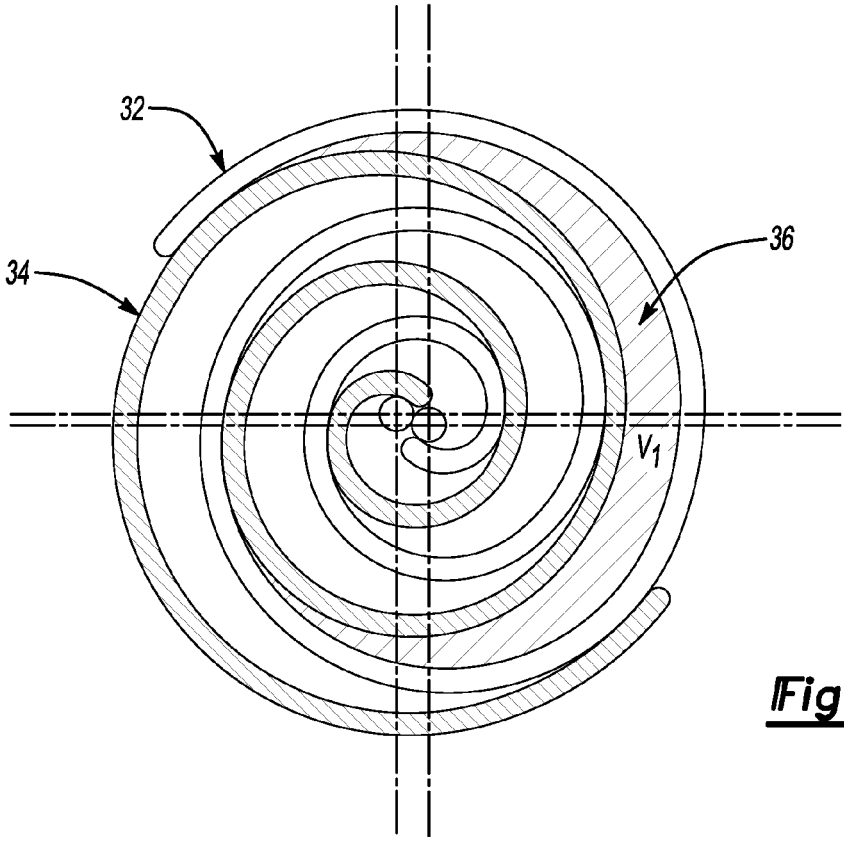
FIG. 4 is a schematic illustration of a scroll compressor showing a compression pocket at the beginning of a compression cycle just after completion of suction.
Figure 5:
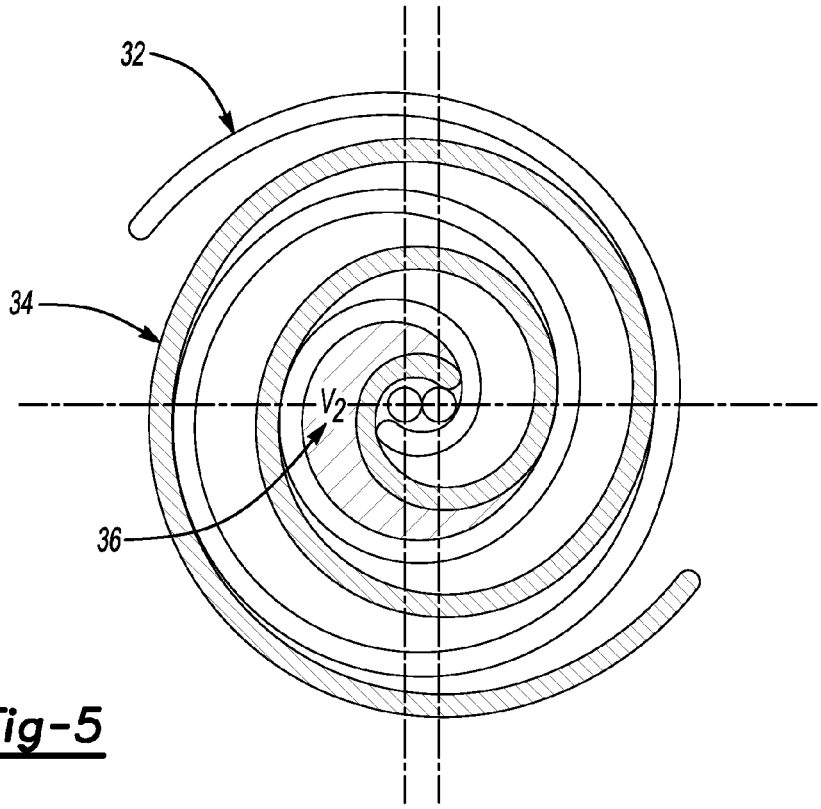
FIG. 5 is a schematic illustration of the scroll compressor of FIG. 5 showing the compression pocket at the end of the compression cycle just prior to discharge.

FIG. 4 shows a schematic illustration of the compression pocket 36 formed by the non-orbiting scroll 32 and the orbiting scroll 34 at the beginning of a compression cycle just after completion of suction and FIG. 5 shows a schematic illustration of the compression pocket 36 formed by the non-orbiting scroll 32 and the orbiting scroll 24 at the end of the compression cycle just prior to discharge.

A built-in volume ratio is defined as a volume $V_1$ of the compression pocket 36 at the beginning of the compression cycle just after completion of suction (FIG. 4) to a volume $V_2$ of the compression pocket 36 at the end of the compression cycle just prior to discharge (FIG. 5). The built-in volume ratio $V_1/V_2$ is controlled primarily by the geometry of the non-orbiting scroll 32 and the orbiting scroll 34, and can be modified, for example, by increasing the length L of each of the generally spiral wraps and/or increasing or decreasing the number of turns associated with each of the generally spiral wraps 46.

Because self-modulating scroll compressors reduce capacity by bleeding vapor from the compression pocket 36 back to the suction chamber 26 during lower capacity operation, the completion of suction is delayed effectively reducing built-in volume ratio $V_1/V_2$ to an effective volume ratio during lower capacity operation. However, if built-in volume ratio $V_1/V_2$ is below 2.4, the effective volume ratio at lower capacity will be too low resulting in reduced overall system efficiency during lower capacity operation. As such, in the example embodiment, the built-in volume ratio $V_1/V_2$ is preferably at least 2.4.

In addition, because the built-in volume ratio $V_1/V_2$ is controlled primarily by the geometry of the non-orbiting scroll 32 and the orbiting scroll 34, design and machining constraints typically limit built-in volume ratio $V_1/V_2$ to a maximum of 3.5. As such, in another example embodiment, built-in volume ratio $V_1/V_2$ is at least 2.4 but not greater than 3.5.

In sum, the present invention discloses a preferred minimum built-in volume ratio to optimize overall system efficiency of self-modulated scroll compressors. Although a preferred embodiment of this invention has been disclosed, a worker of ordinary skill in this art would recognize that certain modifications would come within the scope of this invention. For that reason, the following claims should be studied to determine the true scope and content of this invention.

What is claimed is:

1. A self-modulating scroll compressor comprising:

a first scroll member having a first base and a first generally spiral wrap extending from the first base;

a second scroll member having a second base and a second generally spiral wrap extending from the second base, the first wrap of the first scroll member and the second wrap of the second scroll member interfitting to define compression chambers, the second scroll member being driven to orbit relative to the first scroll member to compress a refrigerant entrapped in the compression chambers during a compression cycle, wherein the compression chambers define a first volume at a beginning of the compression cycle and a second volume at the end of the compression cycle;

the self modulating scroll compressor operating at least at a higher capacity and a lower capacity, wherein a ratio of the first volume to the second volume defines a built-in volume ratio at the higher capacity that is modified to optimize overall compressor efficiency;

the built-in volume ratio decreasing to an effective volume ratio at the lower capacity operation; and the built-in volume ratio being modified to be at least 2.4.

2. The scroll compressor as recited in claim 1, wherein the built-in volume ratio is modified to be at least 2.4 but not greater than 3.5.

3. The scroll compressor as recited in claim 1, wherein the first generally spiral wrap and the second generally spiral wrap each include a predetermined number of turns and the built-in volume ratio is modified by increasing the predetermined number of turns.

4. The scroll compressor as recited in claim 1, wherein the first generally spiral wrap and the second generally spiral wrap each define a wrap length, and the built-in volume ratio is modified by increasing the wrap length.

* * * * *